US007699435B2

(12) United States Patent
Grosse et al.

(10) Patent No.: US 7,699,435 B2
(45) Date of Patent: Apr. 20, 2010

(54) UNIQUELY SPACED MARKINGS

(75) Inventors: Jason Charles Grosse, Vancouver, WA (US); Rick M. Tanaka, Vancouver, WA (US); Edward L. Feldhousen, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1149 days.

(21) Appl. No.: 11/058,495

(22) Filed: Feb. 15, 2005

(65) Prior Publication Data

US 2006/0181570 A1 Aug. 17, 2006

(51) Int. Cl.
*B41J 23/00* (2006.01)
*B41J 29/38* (2006.01)

(52) U.S. Cl. ..... 347/37; 347/14

(58) Field of Classification Search ..... 341/11, 341/13; 347/16, 19, 37, 14, 11, 13; 250/231.18
See application file for complete search history.

(56) References Cited

U.S. PATENT DOCUMENTS

| | | | | |
|---|---|---|---|---|
| 3,858,703 | A | 1/1975 | Duley | |
| 3,910,396 | A | 10/1975 | Eischen et al. | |
| 3,970,183 | A | 7/1976 | Robinson et al. | |
| 4,064,983 | A | 12/1977 | Inose et al. | |
| 4,179,223 | A | 12/1979 | Kwan et al. | |
| 4,204,777 | A | 5/1980 | Jen | |
| 4,208,137 | A | 6/1980 | Liu | |
| 4,281,938 | A | 8/1981 | Phillips | |
| 4,533,268 | A | 8/1985 | Sanders, Jr. | |
| 4,786,803 | A | 11/1988 | Majette et al. | |
| 4,789,874 | A * | 12/1988 | Majette et al. | 347/37 |
| 4,847,633 | A | 7/1989 | Platt et al. | |
| 5,563,591 | A * | 10/1996 | Jacobs et al. | 341/13 |
| 5,676,475 | A | 10/1997 | Dull | |
| 5,852,459 | A | 12/1998 | Pawlowski, Jr. et al. | |
| 6,140,636 | A | 10/2000 | Norton et al. | |
| 6,254,292 | B1 | 7/2001 | Navarro | |
| 6,267,466 | B1 | 7/2001 | Gudaitis et al. | |
| 6,352,332 | B1 | 3/2002 | Walker | |
| 6,428,879 | B1 | 8/2002 | Hansel et al. | |
| 6,616,263 | B2 | 9/2003 | Allen et al. | |
| 6,623,096 | B1 | 9/2003 | Castano et al. | |
| 6,659,578 | B2 | 12/2003 | Gudaitis et al. | |
| 6,822,220 | B2 | 11/2004 | Lesniak | |
| 7,036,902 | B2 * | 5/2006 | Shoji | 347/14 |
| 2004/0165023 | A1 * | 8/2004 | Kang et al. | 347/16 |

FOREIGN PATENT DOCUMENTS

| | | |
|---|---|---|
| JP | 02179779 A2 | 7/1990 |

* cited by examiner

*Primary Examiner*—Julian D Huffman
*Assistant Examiner*—Jason S Uhlenhake

(57) ABSTRACT

Embodiments of uniquely spaced markings are disclosed.

13 Claims, 8 Drawing Sheets

UNIQUELY SPACED MARKINGS

An imaging device, such as an inkjet printer, employs one or more pens to place ink onto a sheet of paper or other media. The pens can be mounted on a carriage, which is arranged to scan back and forth along a path across a width of the media sheet. A given pen includes an array of nozzles that eject individual drops of ink. The drops collectively form a band or "swath" of an image, such as a picture, chart, or text. As the media sheet is advanced, an image is incrementally printed.

When the position of the carriage along the path is known, the printer can precisely time when and which nozzles eject ink. Determining the position of the carriage is sometimes difficult, particularly when powering up after the device has been powered down.

DETAILED DESCRIPTION

Introduction: A typical ink printer, such as an inkjet printer, advances a media sheet past a carriage scanning one or more pens back and forth across the sheet along a path. The pens are instructed to eject ink onto the sheet forming a desired image. To precisely form the image, the printer benefits from tracking the precise position of the carriage along the path. Various embodiments operate to identify or otherwise confirm the position of an object, such as a carriage.

The following description is broken into sections. The first section, labeled "Encoder Strips describes exemplary encoder strips that can be used to determine the position of an object along a path. The second section labeled "Components," describes an example of the physical and logical components that can be used to determine the position of an object along a path. The third section, labeled "Operation," describes an exemplary series of method steps for determining the position of an object along a path.

Figure 1:
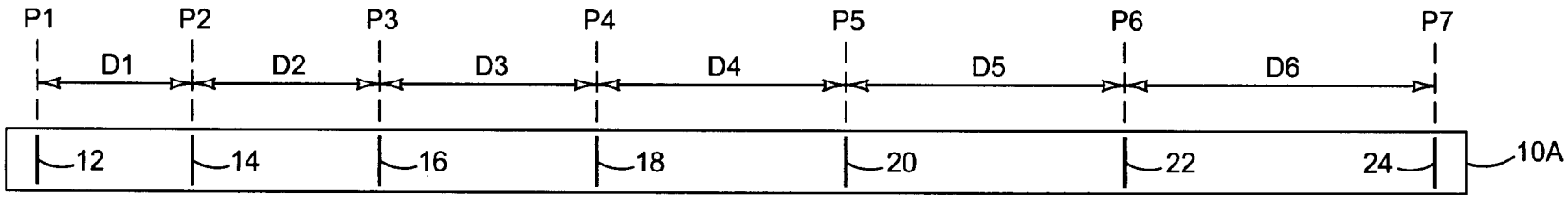
FIGS. 1-6 are views of exemplary encoder strips according to various embodiments.

Encoder Strips FIGS. 1-6 illustrates exemplary encoder strips 10A-10F. Starting with FIG. 1, encoder strip 10A includes index markings 12-24 uniquely spaced along a surface. Each index marking has a known position P1-P7 along encoder strip 10A. The unique spacing of index markings 12-24 means that the distance between each pair of adjacent markings is different than the distances between the other pairs of adjacent index markings. In the example of FIG. 1, distances D1-D6 represent the distances between pairs of adjacent index markings 12/14, 14/16, 16/18, 18/20, 20/22, and 22/24. Each of distances D1-D6 is unique in that it is different than the other distances.

Because distances D1-D6 are unique, upon identifying a distance D1-D6, a pair adjacent of index markings corresponding to that distance can be identified. In other words, without first knowing which adjacent pair of index markings have been detected, that pair can be identified where the distance between the pair is known. Where the relative positions of the index markings are also known, a position along a path adjacent to encoder strip can also be determined. In the example shown, D1 corresponds Index markings 12 and 14 at positions P1 and P2; D2 corresponds to index markings 14 and 16 at positions P2 and P3; and so forth. By identifying distance D6, for example, one can identify index markings 22 and 24 at known positions along encoder strip 10A or a path adjacent to encoder strip 10A.

Figure 2:
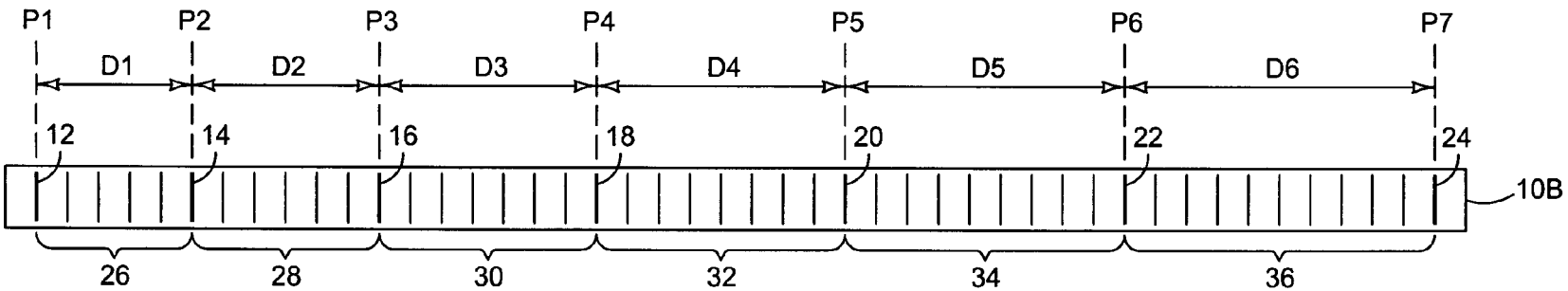
Figure 3:
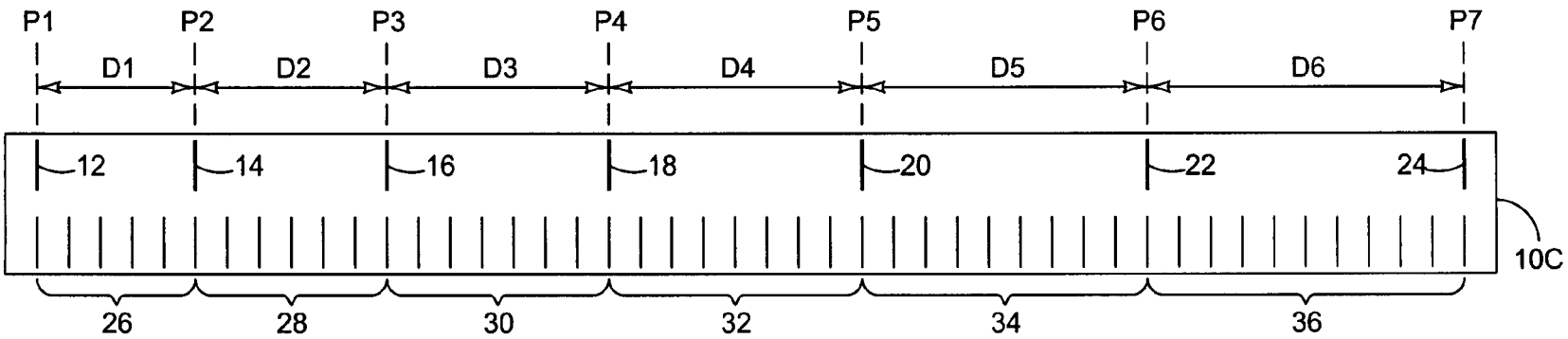

Moving to FIG. 2, Encoder strip 10B also includes index markings 12-24 uniquely spaced along a surface. As above, each index marking has a known position P1-P7 along encoder strip 10B. Encoder strip 10B also includes uniformly positioned encoder markings 25 interspaced between index markings 12-24. Because of their uniform spacing, encoder markings 25 can be used to identify distances between index markings 12-24. In this example, the number of encoder markings in a particular group 26-36 corresponds to a particular distance D1-D6. As shown in FIG. 2, the index markings 12-24 may be of different size than the encoder markings 25. In some embodiments, the index markings 12-24 may be taller and/or wider than the encoder markings 25. In other embodiments, the index markings 12-24 may be shorter and/or narrower than the encoder markings 24. Further, the index markings 12-24 may be of different sizes relative to each other. FIG. 3 illustrates encoder strip 10C in which index markings 12-24 and encoder markings 25 are separated on two different longitudinal portions of encoder strip 10C.

In the examples of FIGS. 1-3 index markings 12-24 and encoder markings 25 are shown as visible lines. However, index markings 12-24 and encoder markings 25 can take any detectable form—optical, magnetic, or otherwise. Index and encoder markings may be nontransparent markings formed on a transparent surface. Alternatively, the markings may be transparent portions of a nontransparent surface. A transparent portion may be a void in the encoder strip or a see-though window or surface.

Figure 4:
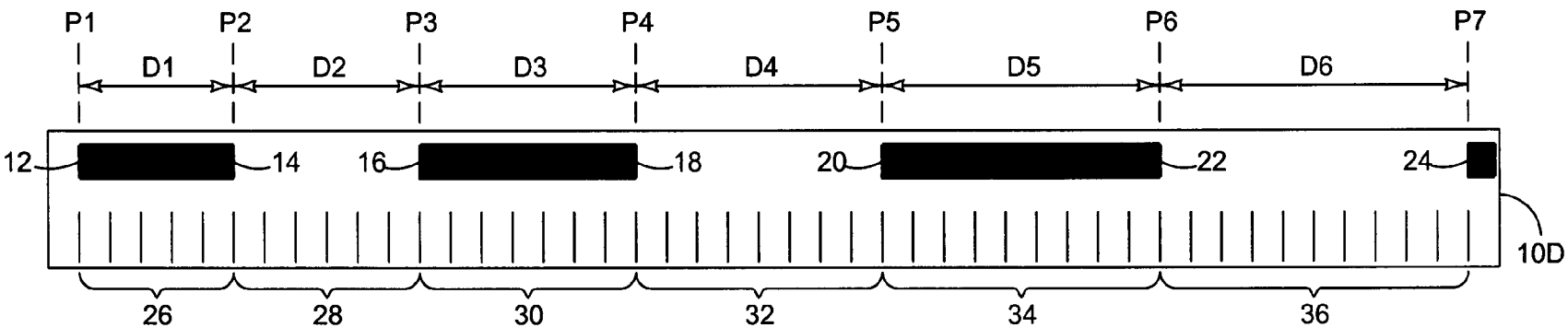

FIG. 4 illustrates encoder strip 10D in which index markings 12-24 take the form of transitions. As shown, those transitions may be optical transitions between light and dark portions and/or transparent and nontransparent portions. As above, a transparent portion may simply be a void in the encoder strip or a see-though window or surface.

Figure 5:
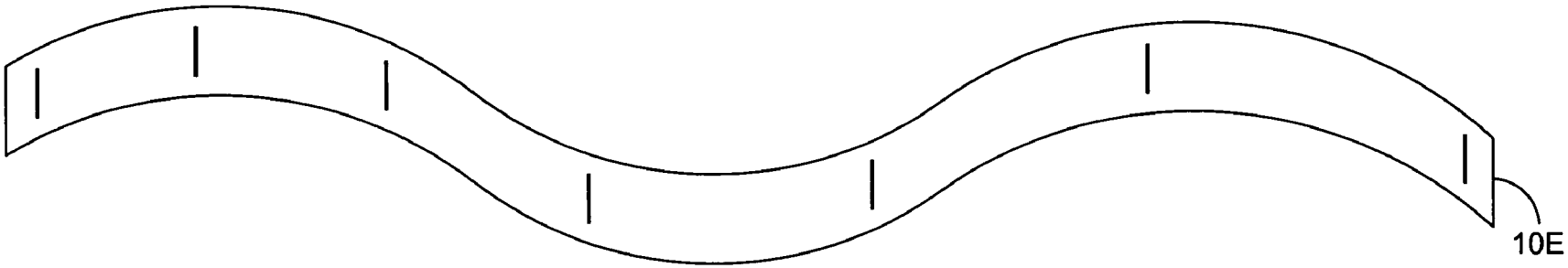
Figure 6:
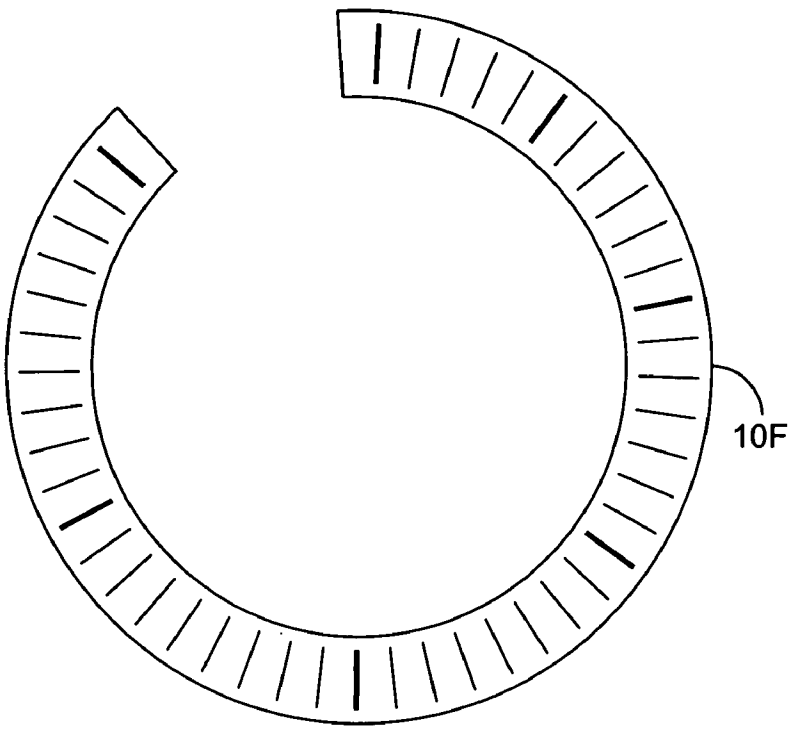

Encoder strips 10A-10D in FIGS. 1-4 are illustrated as being straight. However, that need not be the case. FIG. 5 illustrates a curved encoder strip 10E. FIG. 6 illustrates a circular encoder strip 10F. The particular shape of an encoder strip can be determined by the shape of the path along which the position of an object is to be determined.

Figure 7:
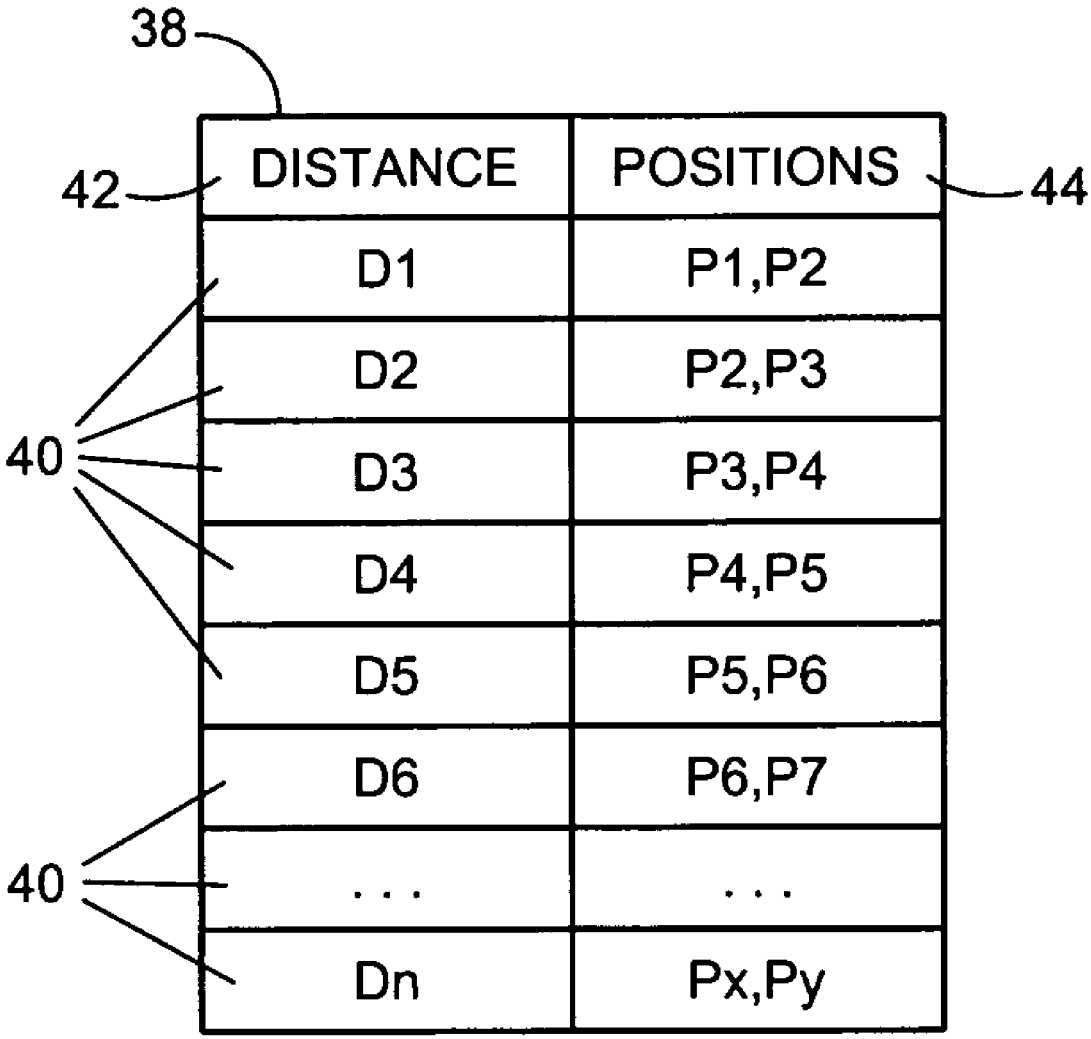
FIG. 7 illustrates a table correlating each of a series of distances with position information according to an embodiment.

FIG. 7 is an exemplary look-up table 38 for use in determining a position along a path adjacent to an encoder strip such as one of encoder strips 10A-10F (FIGS. 1-6). Table 38 represents reference data correlating each of a series of distances with position information. The distances each represent a distance between an adjacent pair of index markings, and the position information identifies the relative position of those markings.

In the example shown, table 38 includes a number of entries 40. Each entry 40 has a distance field 42 and a positions field 44. Each of distance fields 42 contains data identifying a distance between an adjacent pair of index markings. For example, that data may identify a number of encoder markings positioned between the adjacent pair of index markings. Each positions field 44 contains data identifying the positions of a corresponding pair of adjacent markings. Upon identifying a distance between an adjacent pair of index markings, that distance can be used to identify a matching entry 40 in table 38. A matching entry 40 is an entry having data in distance field 42 matching the identified distance. Data can then be obtained from positions field 44 of the matching entry 40 to determine the positions of that adjacent pair of index markings.

Figure 8:
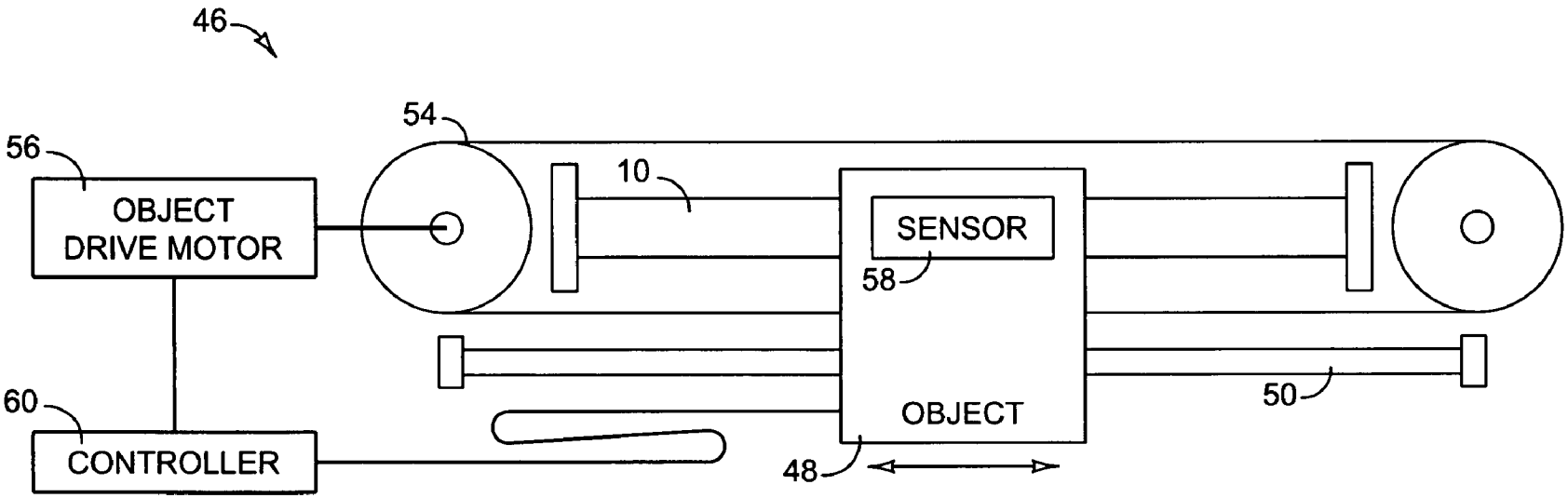
FIG. 8 is a schematic view of a system of identifying the position of an object along a path according to an embodiment.

COMPONENTS: FIG. 8 illustrates an exemplary system 46 for determining the position of an object 48 along a path. As shown, object 48 represents generally any structure that can be moved along a path defined by track 50. For example, track 50 may be a rail configured to slide through a slot formed in object 48. In some embodiments, the rail may comprise one or more carriage rods. When rotated, object drive 54 causes object 48 to move along track 50 in one of two directions depending upon the direction in which object drive 54 is rotated by object drive motor 56. Object drive motor 56 represents generally any suitable motor, such as a stepper motor, capable of rotating object drive 54.

System 46 includes encoder strip 10, sensor 58, and controller 60. Encoder strip 10 is placed adjacent to the path defined by track 50. Sensor 58 is coupled to object 48 and positioned generally adjacent encoder strip 10. Sensor 58 represents generally any device capable of detecting index markings on encoder strip 10 as object 48 moves along the path. Depending on the nature of encoder strip 10, sensor 48 may, for example, be an optical sensor or a magnetic sensor. Sensor 48 may also be employed to detect encoder markings if present on encoder strip. Sensor 48 may include one or more sensor elements. For example, sensor 48 may have one sensor element responsible for detecting index markings and a second sensor element responsible for detecting encoder markings.

Controller 60 represents generally any combination of hardware and programming capable of communicating with sensor 58 to determine the position of object 48 as it moves along the path defined by track 50. Controller 60 may also be responsible for directing object drive motor 56 to cause object drive 54 to move object 48.

As object 48 is caused to move along the path defined by track 50, controller 60 utilizes sensor 58 to identify a value corresponding to a distance between an adjacent pair of index markings on encoder strip 10. Because sensor 58 is coupled to object 48, controller 60 can determine the position of object 48 relative to that pair of adjacent index markings. Using the identified distance and a known direction of travel of object 48 along the path, controller 60 can identify the position of that pair of adjacent index markings along encoder strip 10 and thus the position object 48 along the path defined by track 50. With the relative position of object 48 known, controller 60 can then cause object drive motor 56 to reposition object 48 to a desired location along the path defined by track 50.

To further illustrate, object 48 can travel back and forth in two directions along the path defined by track 50. As shown in FIG. 8, those directions are from left to right and from right to left. However, those directions need not be so oriented. They need not even be linear. Referring back to FIG. 7, position field 42 in each entry 40 identifies two values each corresponding to a position of an index marking along a path relative to a default direction of travel along that path. The default direction of travel is simply a predetermined direction of travel along the path. The first value in position field 44 of an entry 40 may be smaller or greater than the second value. The greater value represents the position of the index making furthest along the path in the default direction of travel.

As object 48 moves in the default direction of travel along the path, controller 60 utilizes sensor 58 to identify a first index marking and then a second index marking adjacent to the first. Upon identifying a distance between the adjacent index markings, controller 60 accesses table 38 (FIG. 7) and identifies an entry 40 having a value in its distance field 38 that corresponds to the identified distance between the identified adjacent index markings. Accessing the positions field 44 of that entry 40, controller 60 can determine that the greater value represents the relative position of the index marking most recently identified and thus the relative position of object 48. Object 48 may instead be moving opposite the default direction along the path. In such a case, controller 60 can determine that the lesser value represents the relative position of the index marking most recently identified and thus the relative position of object 48.

Figure 9:
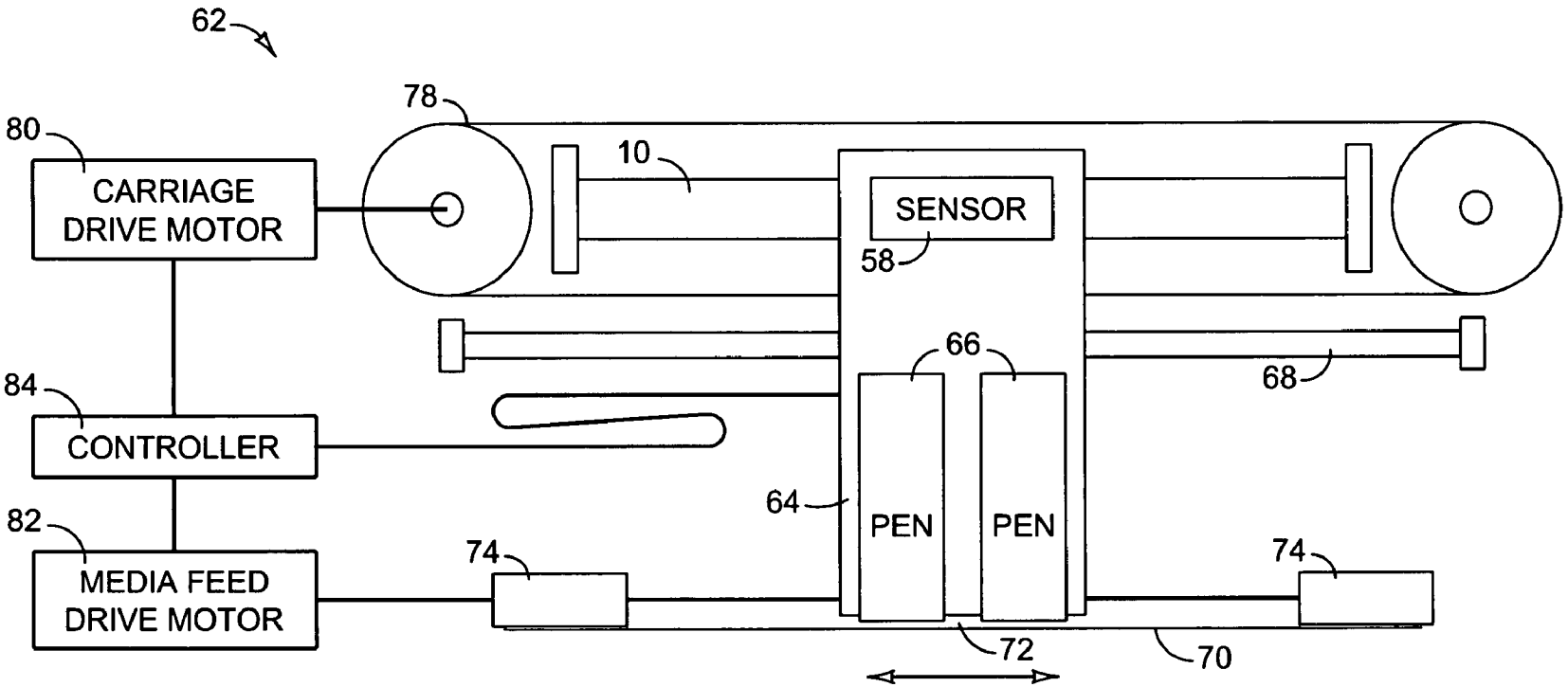
FIG. 9 is a schematic view of a system of an image forming device according to an embodiment.

FIG. 9 illustrates an image forming device 62 in which various embodiments of the present invention may be implemented. Image forming device 62 is shown to include carriage 64. Carriage 64 represents generally any suitable structure for carrying pens 66. In this example, carriage 64 is designed so that it can be moved along a path defined by track 68 which may slide through a slot formed in carriage 64. Pens 66 are responsible for ejecting ink on print medium 70 being advanced through print zone 72. In some embodiments a single pen is employed while in other embodiments two or more pens may be employed.

Feed roller 74 represents generally any structure that when rotated is capable of advancing print medium past carriage 64. The roller 74 may comprise one or more drums, belts, rollers, or a suitable combination of these elements. When rotated, carriage drive 78 causes carriage 64 to move along track 68 in one of two directions depending upon the direction in which carriage drive 78 is rotated by carriage drive motor 80. Carriage drive motor 80 represents generally any suitable motor, such as a stepper motor, capable of rotating carriage drive 78. Media feed drive motor 82 represents generally any suitable motor capable of rotating feed roller 74.

Image forming device 62 also includes encoder strip 10, sensor 83, and controller 84. Encoder strip 10 is placed adjacent to the path defined by track 68. Sensor 83 is coupled to carriage 64 and positioned generally adjacent encoder strip 10. Sensor 83 represents generally any device capable of detecting index markings on encoder strip 10 as carriage 64 moves along the path defined by track 68. Depending on the nature of encoder strip 10, sensor 83 may, for example, be an optical sensor or a magnetic sensor. Sensor 83 may also be responsible for detecting encoder markings if present on encoder strip. Sensor 83 may include one or more sensor elements. For example, sensor 83 may have one sensor element responsible for detecting index markings and a second sensor element responsible for detecting encoder markings.

Controller 84 represents generally any suitable combination of hardware and programming capable of communicating with sensor 83 to determine the position of carriage 64 as the carriage 64 moves along the path defined by track 68. Controller 84 may also be used for (1) directing carriage drive motor 80 to cause carriage drive 78 to move object 48, (2) directing media feed drive motor to cause drive roller 74 to advance print medium 70 past carriage 64, and (3) causing pens to eject ink.

As carriage 64 is caused to move along the path defined by track 68, controller 84 utilizes sensor 83 to identify a distance between an adjacent pair of index markings on encoder strip 10. Because sensor 83 is coupled to carriage 64, controller 84 can determine the position of carriage 64 relative to that pair of adjacent index markings. Using the identified distance, controller 84 can identify the position of that pair of adjacent index markings along encoder strip 10 and thus the position carriage 64 along the path defined by track 68. With the relative position of carriage 68 known, controller 84 can then cause carriage drive motor 80 to reposition carriage 68 to a desired location along the path defined by track 68 allowing pens to eject ink on desired portions of advancing print medium 70.

Figure 10:
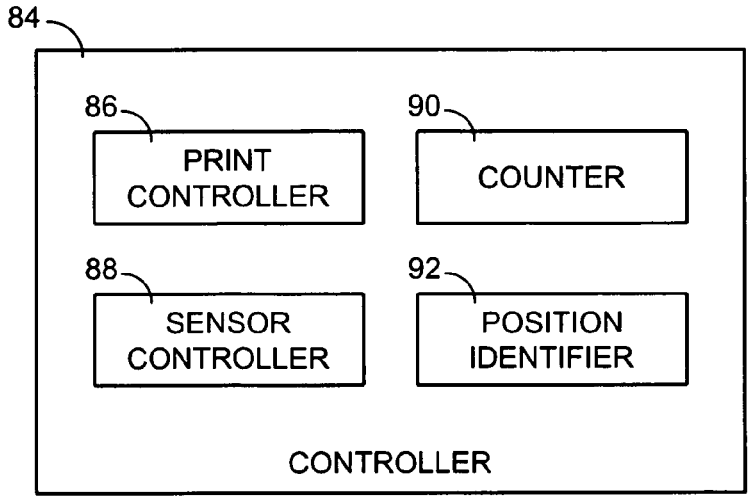
FIG. 10 is a block diagram illustrating logical elements of a controller according to an embodiment.

FIG. 10 is a block diagram illustrating an example of the physical and logical components of controller 84 of FIG. 9. As shown, controller 84 includes print controller 86, sensor controller 88, table 38 (see FIG. 7), counter 90, and position identifier 92. Print controller 86 represents generally any combination of hardware and/or programming capable of directing the operation of pens 66, carriage drive motor 80, and media feed drive motor 82, in order to form a desired image on print medium 70.

Sensor controller 88 represents generally any hardware and/or programming capable of directing sensor 83 to detect index markings and encoder markings as carriage 64 is moved along a path defined by track 68. Counter 90 represents generally any hardware and/or programming capable of keeping a running count of the number of encoder markings detected by sensor 83 as carriage 64 moves along that path. Position identifier 92 represents generally any hardware and/or programming capable of identifying an adjacent pair of index markings detected by sensor 83 and to identify a distance between the identified index markings. Position identifier 92 is also used for using the identified distance to determine a position of carriage 64 along the path.

In this example, position identifier 92 may record the number of encoder markings counted as a first index marking is detected and then again as a second adjacent index marking is detected. Subtracting the two counts, position identifier 92 can identify the number of encoder markings between the pair of adjacent index markings. Using that difference, position identifier 92 then locate a matching entry 40 in table 38 (see FIG. 7) and retrieve data identifying the position of the adjacent index markings and thus the position of carriage 64 along the path defined by track 68.

Figure 11:
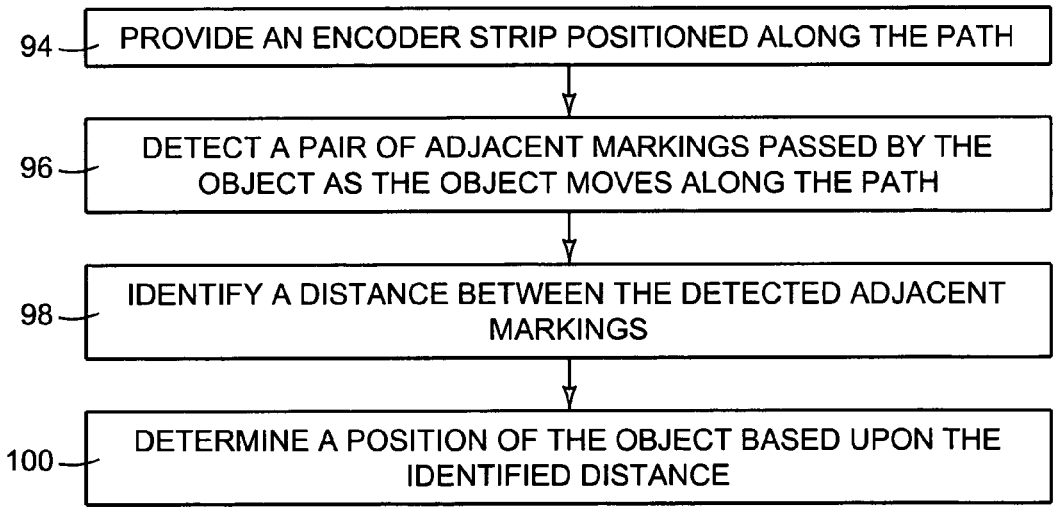
FIGS. 11 and 12 are exemplary flow diagram illustrating steps taken to implement various embodiments.
Figure 12:
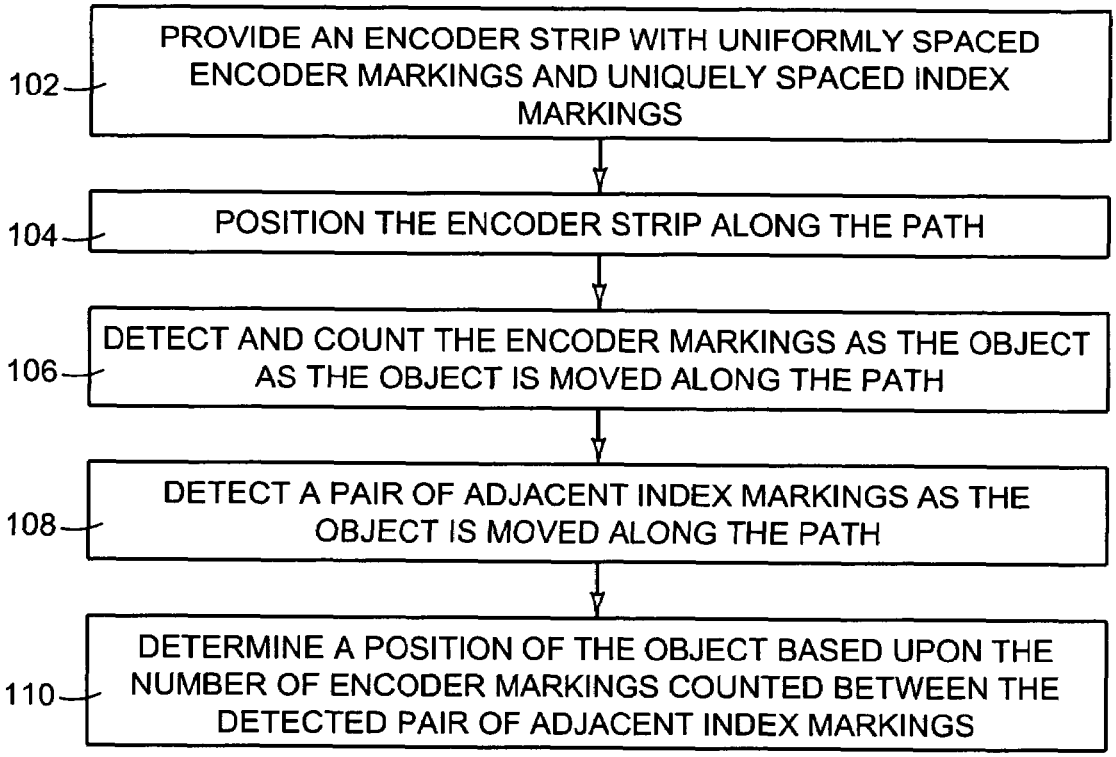

Operation: The operation of embodiments of the present invention will now be described with reference to the exemplary flow diagrams of FIGS. 11 and 12. FIGS. 11 and 12 each illustrate method steps for implementing an exemplary embodiment.

Starting with FIG. 11, an encoder strip, such as one of encoder strips 10A-10F (FIGS. 1-6), is positioned along a path (step 94). A pair of adjacent index markings are detected as the object moves along the path (step 96). The position of the object relative to the detected pair of index markings is known. For example, step 96 may be accomplished using a sensor coupled or otherwise mounted to the object, so that at the time an index marking is detected by the sensor, it can be concluded that the object is adjacent to that index marking.

A value corresponding to a distance between the index markings detected in step 96 is identified (step 98). Where the velocity of the object along the path is known, the value may be identified by measuring the time between when each of the pair of index markings are detected as the object moves along the path. The position of the object is determined based upon the distance identified in step 98 (step 100).

Moving to FIG. 12, an encoder strip with uniformly spaced encoder markings and uniquely spaced index markings is provided (step 102). Encoder strips 10B, 10C, 10D, and 10F in FIGS. 2, 3, 4, and 6 are examples. The encoder strip is positioned along a path (step 104) so that the relative positions of the index markings along the path are known. Encoder markings are detected and counted as an object is moved along the path (step 106).

A pair of adjacent index markings are detected as the object moves along the path (step 108). A position of the object is then determined based upon the number of encoder markings counted between the detected pair of adjacent index markings (step 110). Step 110 may be accomplished, for example, by recording the number of encoder markings counted as a first index marking is detected and then again as a second adjacent index marking is detected. Subtracting the two counts reveals the number of encoder markings between the pair of adjacent index markings. Using that difference, a matching entry 40 in table 38 (see FIG. 7) can be located and data identifying the position of the adjacent index markings can be retrieved.

Conclusion: FIGS. 1-6 show examples of encoder strips. However, implementation of the present invention is not limited to the particular geometry shown. An encoder strip can include any suitable number of uniquely spaced index markings and any number encoder markings uniformly spaced at any suitable resolution. For ease of illustration, the index and encoder markings are shown as lines. However, index and encoder markings may be any suitable shape.

The schematic and block diagrams of FIGS. 8-10 show the architecture, functionality, and operation of various embodiments of the present invention. A number of the blocks are defined, at least in part, as programs. Each of those blocks may represent in whole or in part a module, segment, or portion of code that comprises one or more executable instructions to implement the specified logical function(s). Each block may also represent a circuit or a number of interconnected circuits to implement the specified logical function(s).

Also, some embodiments the present invention can be embodied in suitable computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any suitable media that can contain, store, or maintain programs and data for use by or in connection with the instruction execution system. Computer readable media can comprise any suitable one of many physical media such as, for example, electronic, magnetic, optical, electromagnetic, infrared, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

Although the flow diagram of FIGS. 11 and 12 show specific orders, or sequences, of execution, the orders of execution may differ from that which is depicted. For example, the order of execution of two or more blocks may be reversed relative to the order shown. Also, two or more blocks shown in succession may be executed concurrently or with partial concurrence. All such variations are within the scope of the present invention.

The present invention has been shown and described with reference to the foregoing exemplary embodiments. It is to be understood, however, that other forms, details and embodiments may be made without departing from the spirit and scope of the invention that is defined in the following claims.

What is claimed is:

1. A system for determining a position of an object moveable along a path, comprising:

an encoder strip positioned along the path, the encoder strip having a plurality of uniquely spaced second markings formed on a surface so that the surface includes a plurality of pairs of adjacent second markings wherein a distance between each pair of adjacent uniquely spaced second markings is different from distances between all other pairs of adjacent uniquely spaced second markings;

a sensor coupled to the object adjacent to the encoder strip and operable to detect the uniquely spaced second markings as the object moves along the path;

a controller in communication with the sensor and operable, as the object moves along the path, to at least indirectly identify a value corresponding to a distance between a pair of detected adjacent uniquely spaced second markings and to determine a position of the object along the path based at least in part on that value; and, reference data at least indirectly correlating each of a series of values associated with distances with position information, each distance value corresponding to a distance between an adjacent pair of second markings on the encoder strip, the position information at least indirectly identifying the positions of the adjacent pair of second markings along the path, where the controller is operable to determine a position of the object along the path by using the identified value associated with a distance to look-up position information in the reference data.

2. The system of claim 1, wherein the controller is operable to determine a position of the object along the path by at least indirectly utilizing the identified value to look up the position.

3. The system of claim 1, wherein the controller is operable to determine a position of the object along the path by at least indirectly utilizing the identified value and a direction of travel of the object along the path.

4. The system of claim 1, wherein the system is incorporated in an image forming device and wherein the object is a carriage holding a pen.

5. The system of claim 4, further comprising:

a carriage drive operable to move the carriage along the path; and wherein the sensor is at least indirectly coupled to the carriage and operable to sense markings on the encoder strip as the carriage drive moves the carriage along the path.

6. The system of claim 5, wherein the controller is operable to:

direct the carriage drive to move the carriage along the path; and direct the pen to eject ink.

7. A method for identifying a position of an object moveable along a path, comprising:

identifying a distance between a detected pair of adjacent second markings on an encoder strip as the object moves along the path, the adjacent pair of second markings being from a series of a plurality of second markings formed on a surface so that the surface includes a plurality of pairs of adjacent second markings uniquely spaced along the path wherein a distance between each pair of adjacent second markings is different from distances between all other pairs of adjacent second markings;

determining a position of the object along the path based at least in part on that distance, wherein:

a plurality of uniformly spaced first markings are formed on the surface such that a different number of the plurality of first markings are positioned between each pair of adjacent second markings;

identifying a distance between the detected pair of adjacent second markings comprises detecting and counting a number of uniformly spaced first markings positioned on the surface between the detected pair of adjacent second markings and passed by the object as the object moves along the path;

determining the position of the object comprises determining the position of the object based at least in part on a count of a number of detected first markings between the detected pair of adjacent second markings, by:

accessing reference data at least indirectly correlating each of a series of a number of consecutive first markings with position information, each number of consecutive first markings corresponding to a number of first markings between an adjacent pair of second markings on the encoder strip, the position information at least indirectly identifying the positions of the second markings along the path; and determining a position of the object along the path by using the count of the number of detected first markings to look-up position information in the reference data.

8. The method of claim 7, wherein determining comprises determining a position of the object along the path based at least in part on that distance and a known direction of travel of object along the path.

9. The method of claim 7, wherein determining comprises determining the position of the object along the path by at least indirectly utilizing the identified distance to look up the position.

10. A computer readable medium having computer executable instructions for:

identifying a distance between a detected pair of adjacent second markings on an encoder strip as the object moves along the path, the adjacent pair of second markings being from a series of a plurality of second markings formed on a surface so that the surface includes a plurality of pairs of adjacent second markings uniquely spaced along the path wherein a distance between each pair of adjacent second markings is different from distances between all other pairs of adjacent second markings;

determining a position of the object along the path based at least in part on that distance, wherein the instructions for determining include instructions for:

accessing reference data that at least indirectly correlating each of a series of distances with position information, each distance corresponding to a distance between a different adjacent pair of second markings on the encoder strip, the position information at least indirectly identifying the positions of the second markings along the path; and determining the position of the object along the path by using the identified distance to look-up position information in reference data.

11. The medium of claim 10, wherein the instructions for determining include instructions for determining a position of the object along the path based at least in part on that distance and a known direction of travel of object along the path.

12. The medium of claim 10, wherein the instructions for determining include instructions for determining the position of the object along the path by at least indirectly utilizing the identified distance to look up the position.

13. A system for determining a position of an object moveable along a path, comprising:

an encoder strip having a surface and a plurality of first and a plurality of second markings positioned along the surface so that the surface includes a plurality of pairs of adjacent second markings, wherein the first markings are uniformly spaced along the surface and the second markings are spaced so that a distance between each pair of adjacent second markings is unique compared to distances between all other pairs of adjacent second markings and that a different number of the plurality of first markings are positioned between each pair of adjacent second markings;

a means for detecting the second markings on the encoder strip as the object moves along the path;

a means for identifying a distance between a pair of detected adjacent second markings; and a means for determining a position of the object along the path based at least in part on the identified distance, wherein the means for determining comprises:

a means for detecting and counting a number of uniformly spaced first markings positioned between the detected pair of adjacent second markings and passed by the object as the object moves along the path;

a means for accessing reference data at least indirectly correlating each of a series of a number of consecutive first markings with position information, each number of consecutive first markings corresponding to a number of first markings between an adjacent pair of second markings on the encoder strip, the position information at least indirectly identifying positions of the second markings along the path; and a means for determining a position of the object along the path by using the count of the number of detected first markings to look-up position information in the reference data.

* * * * *